US006502305B2

(12) United States Patent
Martins et al.

(10) Patent No.: US 6,502,305 B2
(45) Date of Patent: Jan. 7, 2003

(54) METHOD OF MANUFACTURING A HEAT-EXCHANGER FIN, FINS ACCORDING TO THE METHOD AND EXCHANGE MODULE INCLUDING THESE FINS

(75) Inventors: Carlos Martins, Montfort l'Amaury (FR); Jean-Claude Malgouries, Asnieres (FR)

(73) Assignee: Valeo Thermique Moteur, La Verrier (FR)

( * ) Notice: Subject to any disclaimer, the term of this patent is extended or adjusted under 35 U.S.C. 154(b) by 0 days.

(21) Appl. No.: 09/911,875

(22) Filed: Jul. 25, 2001

(65) Prior Publication Data

US 2002/0020519 A1 Feb. 21, 2002

(30) Foreign Application Priority Data

Jul. 25, 2000 (FR) ..... 00 09724

(51) Int. Cl.[7] ..... B21D 53/02

(52) U.S. Cl. ..... 29/890.047; 72/379.2; 165/135; 165/140

(58) Field of Search ..... 165/140; 72/379.2; 29/890.047

(56) References Cited

U.S. PATENT DOCUMENTS

| | | | | |
|---|---|---|---|---|
| 3,376,684 A | * | 4/1968 | Cole et al. | 428/119 |
| 4,068,366 A | * | 1/1978 | Hillesheim | 29/527.4 |
| 5,033,540 A | * | 7/1991 | Tategami et al. | 165/135 |
| 5,302,466 A | * | 4/1994 | Davis et al. | 428/573 |
| 5,509,199 A | | 4/1996 | Beamer et al. | |
| 5,992,514 A | | 11/1999 | Sugimoto et al. | |

FOREIGN PATENT DOCUMENTS

| | | | |
|---|---|---|---|
| EP | 0179646 | 4/1986 | |
| EP | 0431917 | 6/1991 | |
| JP | 60253792 | 12/1985 | |
| JP | 11147148 | 6/1999 | |
| JP | 11147149 | 6/1999 | |
| JP | 11148793 | 6/1999 | |
| JP | 11159987 | 6/1999 | |
| JP | 11-337104 A * | 12/1999 | F24F/1/00 |

OTHER PUBLICATIONS

Patent Abstract of Japan; Pub. No. 11147148; Pub. Date Jun. 2, 1999.
Patent Abstract of Japan; Pub. No. 60253702; Pub. Date Dec. 14, 1985.
Patent Abstract of Japan; Pub. No. 11147149; Pub. Date Jun. 2, 1999.
Patent Abstract of Japan; Pub. No. 11148793; Pub. Date Jun. 2, 1999.
Patent Abstract of Japan; Pub. No. 11159987; Pub. Date Jun. 15, 1999.

* cited by examiner

*Primary Examiner*—Allen Flanigan
(74) *Attorney, Agent, or Firm*—Liniak, Berenato & White

(57) ABSTRACT

The invention relates to a method of manufacturing a fin for a heat-exchange module which comprises at least two heat exchangers equipped with fluid-circulation tubes and comprising cooling fins common to the exchangers. The fin consists of a metal strip (14) having a width (L1) divided into at least two heat-exchange regions (18, 20) by at least one series of longitudinal oblong holes spaced apart from one another. In accordance with the method of the invention, at least one series of longitudinal slits (22) is formed, spaced apart from one another, in the metal strip (14), and the longitudinal slits are widened so as to form a series of oblong holes spaced apart from one another. According to one embodiment variant, stampings (24) are formed between the longitudinal slits (22), and these stampings are flattened so as to widen the slits (22) and form the oblong holes.

3 Claims, 3 Drawing Sheets

METHOD OF MANUFACTURING A HEAT-EXCHANGER FIN, FINS ACCORDING TO THE METHOD AND EXCHANGE MODULE INCLUDING THESE FINS

FIELD OF THE INVENTION

The invention relates to heat exchangers, for motor vehicles in particular.

BACKGROUND OF THE INVENTION

It relates more particularly to a method of manufacturing a fin for a heat-exchange module which comprises at least two heat exchangers each including a body equipped with fluid-circulation tubes and moreover comprising cooling fins common to the exchangers, the fin consisting of a metal strip having a width divided into at least two heat-exchange regions by at least one series of longitudinal oblong holes spaced apart from one another.

There exist two principal technologies for producing heat exchangers for motor vehicles. According to a first technology, the constituent parts of the exchanger are assembled, then integrated in a single brazing operation. For this type of exchanger, the fins consist of corrugated spacers arranged between the tubes and parallel to them. According to another technology, the constituent parts of the exchanger are assembled exclusively by mechanical means such as crimping. This type of exchanger includes thin, flat fins arranged perpendicularly to the circulation tubes.

A motor vehicle generally includes several heat exchangers, for example a radiator for cooling the engine, a condenser forming part of an air-conditioning circuit and, if appropriate, a supercharging-air cooler or on oil cooler. It is advantageous to group these exchangers together into a single module which can be mounted in the vehicle in a single operation.

Such exchange modules then advantageously include common fins and are traversed by the same airflow. The fact that the fins are common to the various exchangers simplifies manufacture and makes it possible, furthermore, to make the assembly more compact.

Given that the various exchangers which constitute the module operate at different temperatures, it is necessary, in these common fins, to delimit heat-exchange regions specific to each exchanger. To that end, it is known to form series of oblong holes separated by narrow intervals of material so as to avoid thermal bridges between the various heat-exchange regions of the fin. According to the technique currently used, these oblong holes are produced by removing material, for example by perforation punching. This method has the drawback of generating scrap material which is difficult to manage in production and very expensive.

The precise subject of the invention is a method of manufacturing fins for a heat-exchange module including several exchangers which eliminates the production of scrap material.

This result is obtained, in accordance with the invention, by the fact that:

- at least one series of longitudinal slits is formed, spaced apart from one another, in the metal strip; and
- the longitudinal slits are widened so as to form a series of oblong holes spaced apart from one another.

By virtue of this method, the scrap material is eliminated, since the oblong holes are not obtained by removing material but by producing a slit which is then widened in order to constitute the oblong hole. That being so, the necessity of managing the scrap material is eliminated. Moreover, the fin can be produced from a metal strip of narrower width, which also leads to a reduction in its cost of manufacture.

SUMMARY OF THE INVENTION

According to a first variant of the method, stampings are formed between the longitudinal slits and these stampings are flattened so as to widen the slits and form the oblong holes.

According to another variant of the method, at least one series of slits is formed, distributed into two parallel rows spaced apart from one another in the direction of the width of the metal strip, and the metal strip is stretched in the direction of its width so as to widen the slits and form the oblong holes.

The slits of the two rows preferably overlap partially in the longitudinal direction of the metal strip.

The invention also relates to a fin for a heat-exchange module comprising at least two heat exchangers each including a body equipped with fluid-circulation tubes and moreover comprising cooling fins common to the exchangers. This fin is obtained by the method of the invention.

Finally, the invention relates to a heat-exchange module comprising at least two heat exchangers each including a body equipped with fluid-circulation tubes and moreover comprising cooling fins common to the exchangers. The fins are obtained by the method of the invention.

BRIEF DESCRIPTION OF THE DRAWINGS

Other characteristics and advantages of the invention will emerge further on reading the description which follows of embodiment examples given by way of illustration with reference to the attached figures.

In these figures.

DESCRIPTION OF THE PREFERRED EMBODIMENTS

Figure 1:
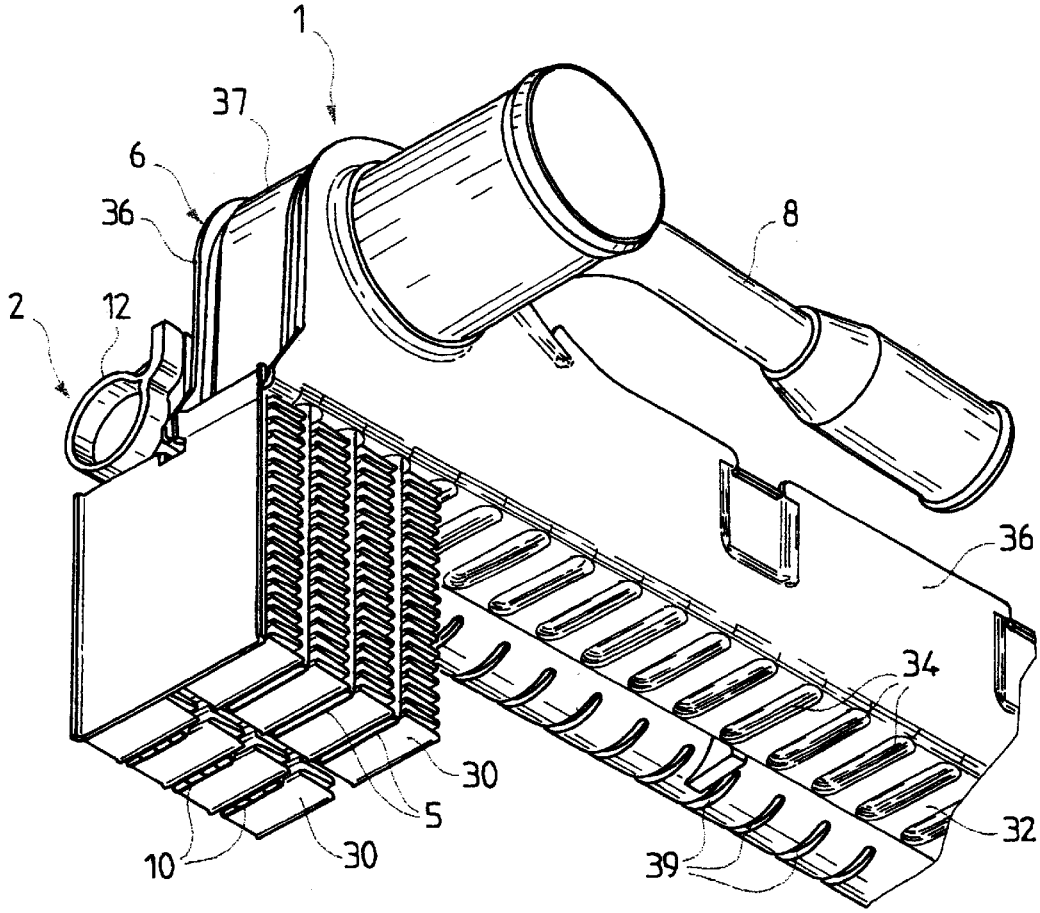
FIG. 1 is a partial view in perspective of a heat-exchange module consisting of two combined exchangers.

The heat-exchange module represented in FIG. 1 consists of a radiator 1 for cooling a motor-vehicle engine and of an air-conditioning condenser 2, these two exchangers being generally flat.

The radiator 1 consists, in a known way, of a bank of vertical, fluid-circulation tubes 5 mounted between two manifold chambers 6 (a single chamber has been represented), the manifold chambers 6 being arranged along two parallel sides of the bank of tubes and equipped with inlet and outlet pipework 8 for the cooling fluid.

The condenser 2 also consists of a bank of vertical, fluid-circulation tubes 10 mounted between two manifold chambers 12 (a single chamber has been represented), the manifold chambers being arranged along two parallel sides of the bank and equipped with inlet and outlet pipework for the refrigerant fluid (not represented).

The fins of the heat-exchange module are common to the two exchangers. In one embodiment, they consist of spacers 30 of corrugated sheet metal arranged between the tubes 5 and 10.

The manifold chamber 6 of the exchanger 1 (FIG. 1) is formed from thin metal sheets, advantageously of aluminium, shaped by conventional cutting-out and stamping operations. It includes a bottom 32 which is generally flat and of elongate rectangular shape. This bottom 32 is intended to constitute the manifold plate, also called "hole plate", of the manifold chamber 6. To that end it includes a plurality of spaced holes 34 of elongate shape intended to receive the tubes 5 of the exchanger 1. The manifold chamber 6 further comprises two side walls 36 folded face-to-face, which are generally flat and parallel to each other. These walls 36 are connected substantially perpendicularly to the bottom 32 by two fold lines which are parallel to each other. The pipework 8 is formed in one of the side walls 36.

The manifold chamber 6 is closed by a metal strip 37 of given width which possesses parallel generatrices. This strip 37 fits between the side walls 36 of the manifold chamber 6 so as to form an assembly which is ready to be brazed at the same time as the pipework 8.

The manifold chamber 12 of the exchanger 2 exhibits the general shape of an elongate cylinder complete with perforations 39 intended to receive the tubes 10 of the exchanger.

Figure 2:
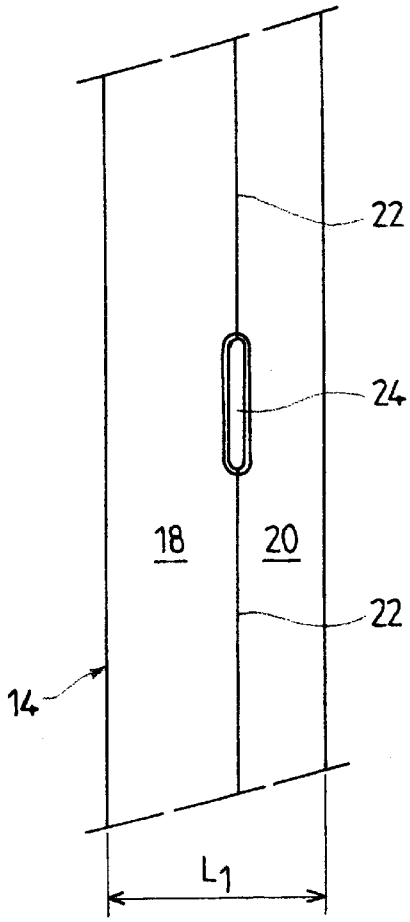
FIG. 2 is a partial top view of a metal strip for producing a fin by the method of the invention.

In FIG. 2 has been represented a strip of sheet metal 14 of great length intended for the production of a fin 30 for a heat module like the one which is represented in FIG. 1. The metal strip 14 has a length L1 which is divided into a first heat-exchange region 18 and a second heat-exchange region 20 by a series of longitudinal slits 22 formed in the sheet-metal strip 14. The sheet-metal strip 14 is divided into as many heat-exchange regions as there are exchangers in the module. Given that the module of FIG. 1 includes two exchangers, namely the radiator 1 and the condenser 2, the strip 14 is divided into two heat-exchange regions 18 and 20. In another embodiment, the heat-exchange module could comprise three exchangers, for example, a supercharging-air cooler in addition to the radiator 1 and the condenser 2. In this case, the metal strip 14 would be divided into three heat-exchange regions by two series of longitudinal slits 22.

It will be noted, furthermore, that the widths of the regions 18 and 20 are not necessarily equal. The width of each of these regions corresponds to the width of the fluid-circulation tubes of each of the exchangers. If the tubes of the radiator 1 are longer than the tubes of the condenser 2, the heat-exchange region 18 intended to establish a heat exchange with the tubes of the radiator 1 will be longer than the heat-exchange region 20 intended to establish a heat exchange with the tubes of the condenser 2.

Figure 3A:
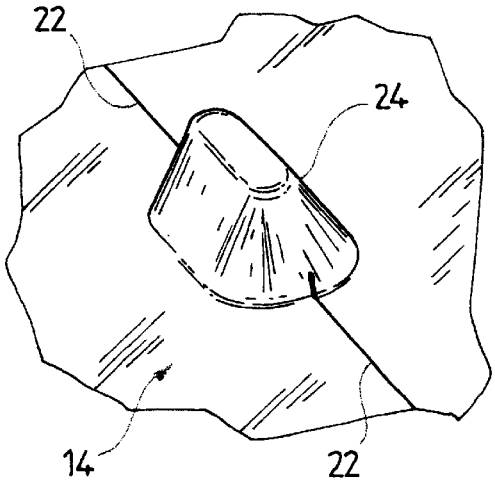
FIG. 3A is a partial view in perspective of a stamping formed between the slits of the metal strip represented in FIG. 2.
Figure 3B:
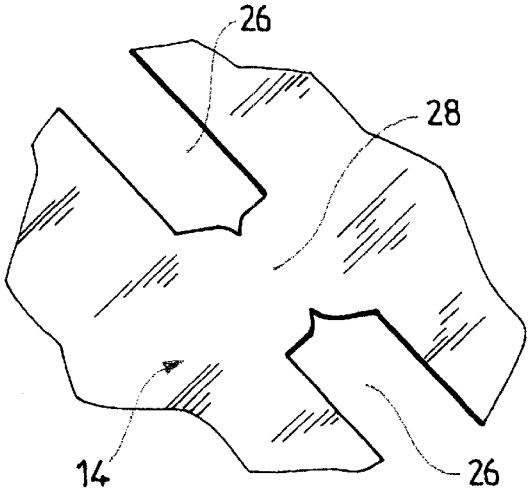
FIG. 3B is a partial view in perspective corresponding to FIG. 3A, after flattening of the stamping.
Figure 4:
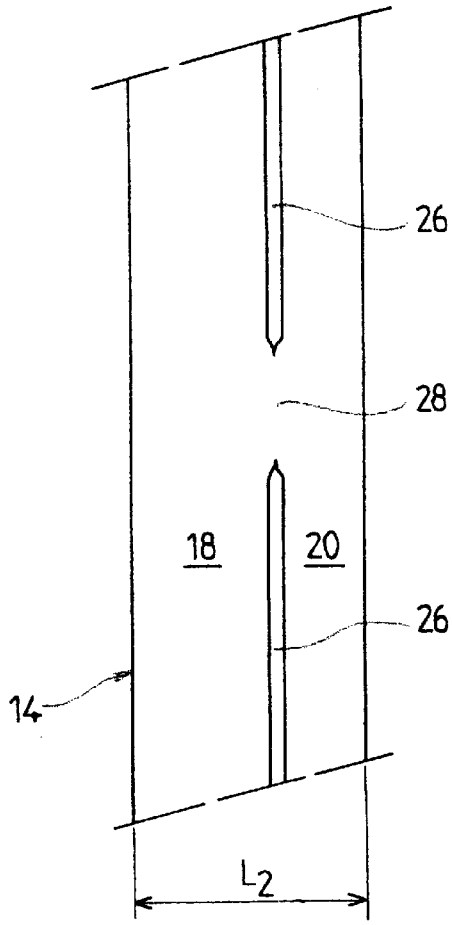
FIG. 4 is a partial top view of the metal strip represented in FIGS. 1 and 2 at a later stage of the method of the invention.

The slits 22 do not extend over the entire length of the metal strip 14. On the contrary, they are spaced apart from one another by regions in which some material remains. In the embodiment example represented in FIG. 2, stampings 24 (see FIG. 3A) are formed in these regions of material. Conversely, it is possible to form the stampings first of all, then to produce the slits 22 between the stampings. The stampings 24 are next flattened so as to space the lips of the slits 22 away from one another and to form oblong holes 26 separated from one another by tongues of sheet metal 28, as represented in FIGS. 3B and 4. It will be noted that, contrary to the method of the prior art, the oblong holes 26 have not been produced by removal of material but by a widening of the sheet-metal strip 14 in the direction of its width. The latter thus exhibits a width L2 which is very slightly greater than its initial width L1, this increase in width corresponding to the width of the oblong holes 26.

Figure 5:
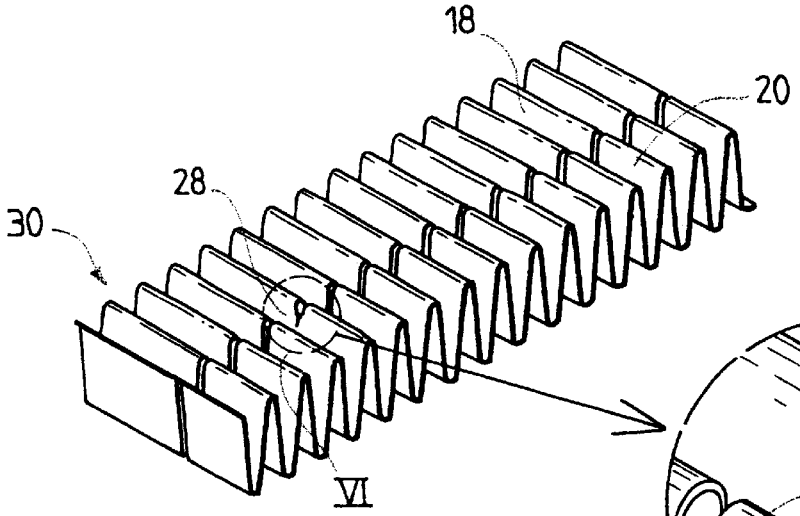
FIG. 5 is a view in perspective of a fin obtained from the metal strip represented in FIG. 4.
Figure 6:
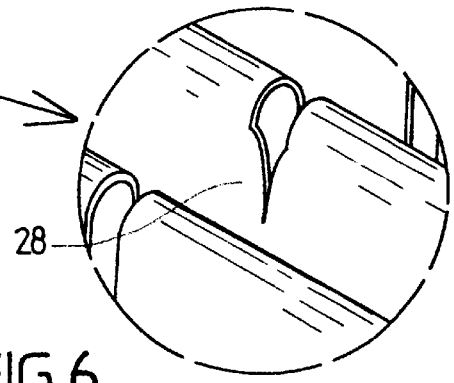
FIG. 6 is a view on an enlarged scale of the detail VI of FIG. 5.

In a subsequent stage of the method, the sheet-metal strip 14 is corrugated in a known way so as to form a corrugated spacer 30 as represented in FIG. 5. This spacer is divided into two heat-exchange regions 18 and 20 by the oblong holes 26 which are interrupted at regular intervals by the tongues of sheet metal 28 which make it possible to provide the mechanical strength of the spacer.

Thus a thermal bridge between the heat-exchange regions 18 and 20 is avoided, the heat exchange being possible only via the sheet-metal tongues 28 the length of which is very much reduced by comparison with the length of the spacer as a whole.

Figure 7:
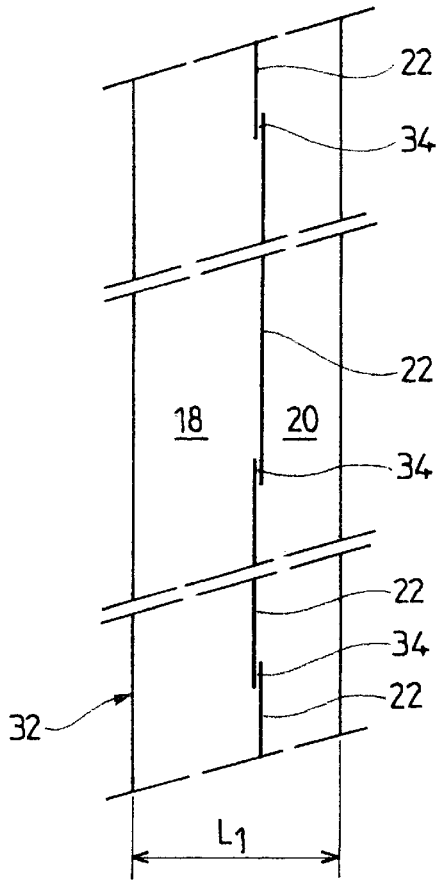
FIG. 7 is a partial top view, similar to FIG. 2, of a metal strip for producing a fin according to one variant of the method of the invention.
Figure 8:
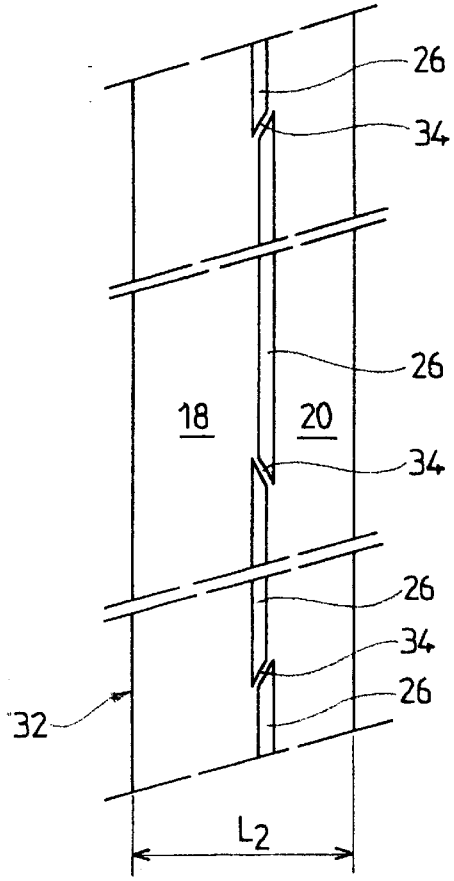
FIG. 8 is a partial top view of the metal strip represented in FIG. 7 at a later stage of the method of the invention.

In FIG. 7 has been represented a sheet-metal strip 32 divided into two heat-exchange regions 18 and 20 by a series of longitudinal slits 22. In this variant, the slits 22 are not arranged in the extension of one another, as in the variant of FIGS. 2 to 6, but are distributed into two parallel rows spaced apart from one another in the direction of the width of the strip 32. Moreover, the slits 22 belonging to each of the two rows overlap partially at each of their extremities. They thus delimit thin tongues of sheet metal 34 between these extremities. In a subsequent stage of the method, the strip 32 is stretched in the direction of its width L1 in a series of rollers producing a spacing of the two exchange surfaces 18 and 20 and consequently a spacing of the lips of the slits 22. It results therefrom that the strip then possesses a width L2 greater than L1.

Figure 9:
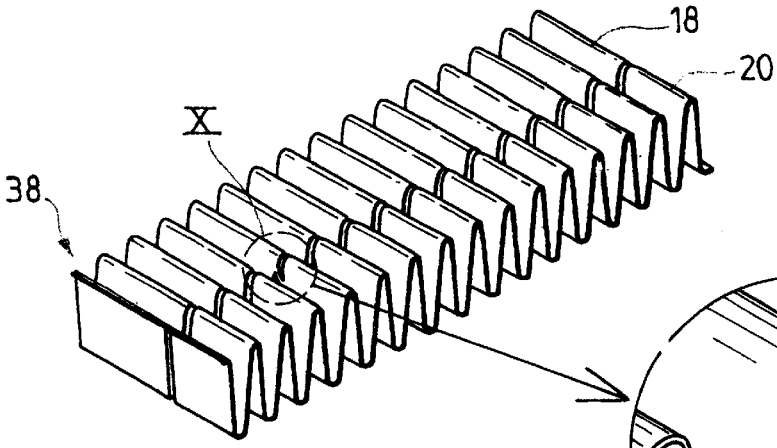
FIG. 9 is a view in perspective of a fin obtained from the metal strip represented in FIG. 8.

Thus oblong holes 26 are formed, extending longitudinally and offset alternately to the left and to the right with respect to one another, and separated from one another by tongues of sheet metal 34. The sheet-metal strip 32 is then corrugated so as, in a known way, to produce a corrugated spacer 38 as represented in FIG. 9.

Figure 10:
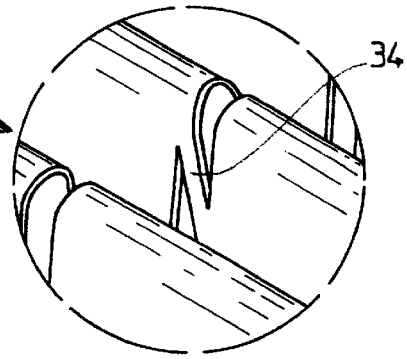
FIG. 10 is a view on an enlarged scale of the detail X of FIG. 9.

The spacer 38 is divided into two heat-exchange regions 18 and 20 separated from one another by the oblong holes 26 interrupted at regular intervals by the tongues of sheet metal 34 arranged obliquely with respect to the longitudinal axis of the sheet-metal strip 32, as can be seen in FIG. 10. This, to the maximum extent possible, prevents a thermal bridge being established between the heat-exchange regions 18 and 20. It will be noted that, in this embodiment also, the oblong holes 26 are obtained without removal of material, which is a considerable advantage because that avoids having to handle such scrap during the manufacture of the spacer 38.

By reference to FIGS. 1 to 10, a heat-exchange module has been described including exchangers of brazed type. It goes without saying that the invention also applies to exchangers of crimped type, assembled mechanically. In such exchangers, the fins consist of thin strips of sheet metal arranged perpendicularly to thin fluid-circulation tubes. In order to avoid a thermal bridge being established between the two heat-exchange regions of the fins, the latter are divided, in an identical way, into two regions by at least one series of longitudinal slits interrupted at regular intervals by tongues of material which are intended to provide the mechanical strength of the fin.

The two variant embodiments of the method which have been described by reference to FIGS. 2 to 6 and 7 to 10 respectively apply in the same way to the production of such fins. Put simply, the fins remain flat and they are not formed into corrugated sheet-metal strip as for an exchanger of brazed type. In contrast, these fins have to be perforated in order to allow the tubes of the exchangers 1 and 2 to pass through.

Clearly, the invention is not limited to the embodiments described above and extends to other variants.

What is claimed is:

1. Method of manufacturing a fin for a heat-exchange module which comprises at least two heat exchangers (1, 2) equipped with fluid-circulation tubes and moreover comprising cooling fins (30, 38) common to the exchanger (1, 2), the fin (30, 38) consisting of a metal strip (14, 32) having a width (L1) divided into at least two heat-exchange regions (18, 20) by at least one series of longitudinal oblong holes (26) spaced apart from one another, characterised in that:

at least one series of longitudinal slits (22) is formed, spaced apart from one another, in the metal strip (14, 32);

the longitudinal slits (22) are widened so as to form a series of oblong holes (26) spaced apart from one another; and stampings are formed between the longitudinal slits (22), said stampings being flattened so as to widen the slits (22) and form the series of oblong holes (26).

2. Method of manufacturing a fin for a heat-exchange module which comprises at least two heat exchangers (1, 2) equipped with fluid-circulation tubes and moreover comprising cooling fins (30, 38) common to the exchanger (1, 2), the fin (30, 38) consisting of a metal strip (14, 32) having a width (L1) divided into at least two heat-exchange regions (18, 20) by at least one series of longitudinal oblong holes (26) spaced apart from one another, characterised in that:

at least one series of longitudinal slits (22) is formed, spaced apart from one another, in the metal strip (14, 32), said slits (22) being distributed into two parallel rows spaced apart from one another in the direction of the width (L1) of the metal strip (32);

the longitudinal slits (22) are widened so as to form a series of oblong holes (26) spaced apart from one another; and the metal strip (32) is stretched in the direction of its width (L1) in order to widen the slits (22) and form the oblong holes (26).

3. Method according to claim 2, characterized in that the slits (22) of the two rows overlap partially in the longitudinal direction of the metal strip (32).

* * * * *